US006413194B1

(12) United States Patent
Gant

(10) Patent No.: US 6,413,194 B1
(45) Date of Patent: Jul. 2, 2002

(54) LUMBAR FLEXING SEATING PAD

(76) Inventor: Richard A. Gant, 401 "B" St. Suite 2200, San Diego, CA (US) 92101

( * ) Notice: Subject to any disclaimer, the term of this patent is extended or adjusted under 35 U.S.C. 154(b) by 0 days.

(21) Appl. No.: 09/427,403

(22) Filed: Oct. 25, 1999

(51) Int. Cl.[7] ..... A61G 7/057
(52) U.S. Cl. ..... 482/112; 5/654
(58) Field of Search ..... 482/112; 5/644, 5/654, 600, 615; 428/116

(56) References Cited

U.S. PATENT DOCUMENTS

| | | | | |
|---|---|---|---|---|
| 2,132,291 A | | 10/1938 | Fitos | |
| 4,826,247 A | | 5/1989 | McGrady et al. | |
| 4,830,345 A | | 5/1989 | Mar | |
| 5,096,529 A | * | 3/1992 | Baker | 156/216 |
| 5,588,704 A | | 12/1996 | Harza | |
| 5,728,049 A | | 3/1998 | Alberts | |
| 5,769,492 A | | 6/1998 | Jensen | |
| 5,829,081 A | * | 11/1998 | Pearce | 65/654 |
| 5,840,400 A | * | 11/1998 | Landi et al. | 428/116 |
| 6,073,284 A | * | 6/2000 | Borders | 5/600 |

* cited by examiner

*Primary Examiner*—Glenn E. Richman
(74) *Attorney, Agent, or Firm*—Thomas J. Tighe

(57) ABSTRACT

A rigid surface upon which a person sits is elastically supported, preferably by a gas-filled bladder assembly which includes two inflatable bladders, one circumscribing the other. The bladders are preferably independently inflated, the inner bladder preferably being inflated to a higher pressure than the outer bladder to act as a fulcrum for the seating surface. The bladder assembly allows two degrees of movement for the seating surface, e.g., pitch and roll rotations about two mutually orthogonal medians. The two degrees of movement permits a user to exercise his or her lumbar cage muscles by seesaw movement of the lower body on the seating surface.

14 Claims, 1 Drawing Sheet

LUMBAR FLEXING SEATING PAD

BACKGROUND OF THE INVENTION

This invention relates in general to the field of resilient seating pads, and more particularly to a resilient seating pad which promotes and assists exercise of the muscles and vertebrae in the lumbar region of a person's spine.

The thoracic portion of the human spinal column is protected and strengthened by the rib cage and the large dorsal and pectoral muscles. Unfortunately, the lumbar region is not as ruggedly supported, having for support only the abdominal muscles, and small, short muscles which connect and interconnect the lumbar vertebrae and the sacral vertebra. For convenience, these small interconnecting muscles are hereafter referred to as the "lumbar cage." It appears that the lumbar cage evolved over the millennia when humans had a short life span and long hours of physical activity each day, but its structure is not well suited for modern man with a much longer life span and whose lifestyle is much more sedentary and inactive. This weaker region (lumbar) of the load-bearing muscular-skeletal structure of the human anatomy is the source of most lower back pain and is also a major factor in back pain associated with structural defects such as scoliosis, a lateral curvature of the spine, spinal stenosis or lumbar disc syndrome.

The strength of a muscle depends upon the amount of work it is required to perform over time. Since muscles can only contract, they are worked by causing them to contract or flex. To flex a bodily joint, certain muscles (flexor muscles) are contracted while opposing muscles (extensor muscles) are relaxed so they can be extended. To straighten the joint, the reverse happens: the extensor muscles contract and the flexor muscles relax. Extensor and flexor muscles of the lumbar cage provide the necessary movement of the lumbar vertebrae, allowing them to be extended and flexed to accommodate the body's activity. These, as well as other muscles in the lumbar cage, are worked by contractions and extension to cause movement of a part or parts of the body, allowing the body to change position and, even while the body is relatively inactive, to maintain position and balance.

Reduced activity, which may result from age, a sedentary job, illness, trauma, or simply a lack of sufficient motivation to exercise, limits the flexion and extension of the lumbar cage, causing these muscles to weaken and atrophy to the point that the load-bearing capacity of the lumbar region becomes more and more limited. The weakening process is progressive and cyclical. As atrophy sets in from reduced muscle activity, the lumbar cage weakens. Eventually, torque or overload beyond the tolerance level of the weakened lumbar cage will either tear the fibers in one of the lumbar cage's muscles or cause a vertebral disc to slip out of alignment, resulting in back pain and, in severe cases, disabling spasms. The pain results in even less activity and, therefore, further atrophy of the lumbar cage.

To defend against any muscular pain the body involuntarily uses other muscles to produce the required body movement, a process called substitution. A body with lower back pain naturally adopts a posture and gait, such as splayed feet, a shuffling movement with no working of the hamstrings, which minimize the natural activity of the lumbar cage. With this reduced activity caused by substitution, the lumbar region becomes weaker, less flexible and vulnerable to further muscle strain and disc displacement. Generally, along with deterioration in the strength and flexibility of the lumbar cage caused by a longer, less active lifestyle, posture is also negatively affected. Having a weakened lumbar cage tends to promote a bowed back and slumped shoulders when seated for long periods at a desk or in front of a computer.

Most people with lower back pain either cannot or will not exercise the lumbar cage adequately to produce the muscle strength necessary to eliminate the problem. Physical therapy for pain is, at best, for a limited time during the therapy session, and therefore is limited in effectiveness. This invention provides an easy, inexpensive and very convenient way for such people to exercise their lumbar cages whenever they are seated, at home or on the job. Its use enhances the tone of the lumbar cage. It enables a seated person to actively exercise the lumbar cage while promoting better posture.

Another major factor in maintaining an over all healthy lower back is avoiding idiopathic (degenerative disc) low back pain. Disc degeneration is irreversible structural alteration in the disc which can be caused by many factors, and results in the reduction in height, loss of hydrated flexibility, one of the forms of herniation, or spinal stenosis (a narrowing of the spinal annulus). Since the intervertebral discs are avascular, that is, they are without blood carrying capillaries, the pumping action from physical activity is the only means of promoting the exchange of fluids for improved nutrition of the cells, for cell replacement, and for removing metabolic by-products. Inactivity of the lumbar spine, caused by a sedentary life style or by the process of muscular substitution to prevent pain, can only accelerate the degenerative process within the discs. This invention produces the essential pumping action, repetitively and constantly during use, and amplifies and intensifies the pumping action so as to prevent, arrest, or decelerate the degenerative process.

Other advantages and attributes of this invention will be readily discernable upon a reading of the text hereinafter.

SUMMARY OF THE INVENTION

An object of this invention is to provide a seating pad which not only cushions but also provides a means for a person to exercise his or her lumbar cage while seated.

An additional object of this invention is to provide an adjustably tiltable lumbar cage flexor seat for supporting a seated person.

An additional object of this invention is to provide a tiltable lumbar cage flexor seat having a generally rigid platform supported by at least two selectively inflatable bladders.

An additional object of this invention is to provide a tiltable lumbar cage flexor seat having one inflatable bladder generally concentrically surrounding another inflatable bladder.

An additional object of this invention is to provide a tiltable lumbar cage flexor seat containing provision for storage of a hand pump for inflating the bladders.

A further object of this invention is to provide a tiltable lumbar cage flexor seat for improvement of a seated person's posture.

These objects, and other objects expressed or implied in this document, are accomplished by a device having a rigid surface upon which a person sits upright, and an elastic support for the surface, the support allowing the surface to be rotated around two mutually orthogonal medians of the surface by selected movement of the person's lower body. The medians are, for example, a front-to-back median and a lateral median. In this way the surface has two degrees of selective movement, e.g. pitch and roll. Preferably the elastic support includes a bladder assembly having a first elastic bladder inflated with a gas, and a second elastic bladder inflated with a gas, the second bladder circumscribing the first bladder. The bladder assembly is preferably centrally disposed beneath the rigid surface and is extensive to the margins of the surface. Preferably the bladders are each individually inflatable to selected pressures. This allows a user to make the first bladder stiffer to more effectively act as fulcrum for the rigid surface. Since the elastic support is a gas-filled bladder assembly, it has a reactive elastic force which remains substantially normal to the rigid surface regardless of the orientation of the surface with respect to the medians. It remains "substantially" normal because when the rigid surface is tilted, a relatively small torque opposing the tilt is caused by the bladders trying to equalize the gas distribution therein. Preferably the invention further includes a base plate, the bladder assembly being sandwiched between the rigid surface and the base plate, a cover for enveloping the sandwich, and a gap in the second bladder for inflation access to the first bladder and optionally for storage of a pump. Preferably the first bladder is circular and the second bladder is toroidal, the toroidal bladder circumscribing the circular bladder, and the bladder assembly is centrally disposed beneath the rigid surface and extensive to the margins of the surface.

DESCRIPTION OF THE PREFERRED EMBODIMENT

Figure 4:
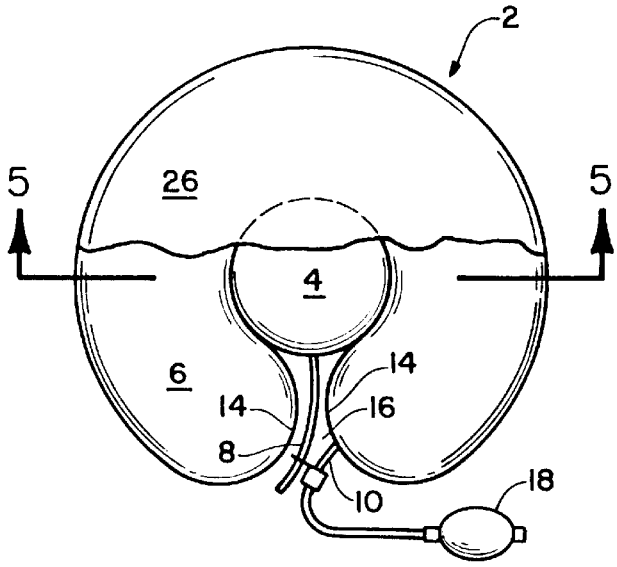
FIG. 4 is a top, partially cut-away view of the illustrated embodiment of this invention illustrating generally concentric inflatable bladders and a hand pump attached to one bladder's valve stem.
Figure 5:
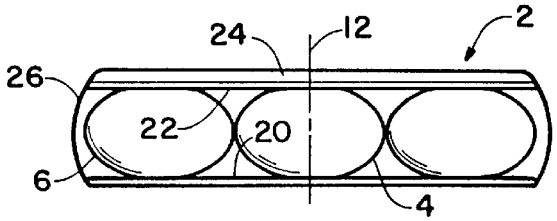
FIG. 5 is a sectional view taken along line 5—5 of FIG. 4.

Referring to FIGS. 4 and 5, a pad according to this invention is generally designated 2. It includes an inner circular bladder 4, disposed snugly in the center of a coaxial, toroidal shaped outer bladder 6. The inner and outer bladders are each independently inflatable by means of valve stems 8 and 10 respectively. The inner bladder is in the form of a flattened sphere and when it is unstressed its wide faces are centered on, and perpendicular to, a vertical axis 12 of the pad. The outer bladder is in the form of a flattened toroid and when unstressed its upper and lower wide faces are generally parallel, respectively, with the upper and lower wide faces of the inner bladder. The outer bladder also has two opposing end lobes 14 which define a gap 16 in its toroidal shape. The valve stems are preferably disposed in the gap and communicate with the interiors of the bladders to allow them to be inflated by means of a pressurized air supply, such as by a hand pump 18, which can be removably connected to the valve stems. When not being used, the hand pump may be stored in the gap 16.

Figure 6:
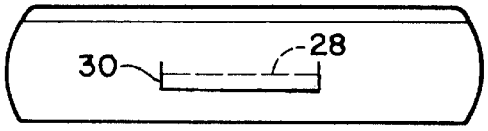
FIG. 6 is a rear view of the illustrated embodiment of this invention.

Referring to FIGS. 4, 5 and 6, the bladder assembly (inner and outer bladders, 4 and 6) is sandwiched between a base plate 20 and a top plate 22. The plates are preferably rigid, generally planar members having an outline preferably similar in shape to the outer contour of the outer bladder 6. The bladder assembly is centrally disposed beneath the top plate, and preferably extensive to the margins of the plate, such that the vertical axis 12 passes through an intersection of two mutually orthogonal medians (not shown) of the top plate, e.g. the intersection of a front-to-back plate median and a lateral plate median. As described in further detail below, the elasticity of the bladder assembly allows the top plate to be rotated about the two medians of the plate by selected movement of the person's lower body. In other words, the top plate has two degrees of selective movement, e.g. pitch and roll, so that it can be selectively tilted over a range of inclination angles and over 360 degrees of orientation.

Referring again to FIGS. 4, 5 and 6, a cushioning material 24, such as polyurethane foam, is preferably affixed to the upper surface of the top plate 22. (As used herein, the terms "upper," "lower," "top," "bottom" and "base" are directional references arbitrarily selected for clarity of understanding, and as used herein "upper" and "top" refer to the direction or side of the pad on which a person would normally sit, and "lower," "bottom" and "base" refer to the direction or side of the pad which faces the supporting structure upon which it rests.) The cushioning material covers the top plate 22 to provide cushioning, as is typical for seating pads. The pad is completely enclosed in a flexible cover 26, preferably affixed to the bottom of the base plate. The cover has an access opening 28 defined in its rear margin, proximate the gap in the outer bladder to allow access to the valve stems and to the hand pump which may be stored therein. The opening 28 is preferably closable by conventional fastening devices, such as a zipper (not shown) or mating hook and loop strips, affixed to the cover and an overlapping flap 30 extending from the cover. The opening is shown aligned horizontally in the middle of the rear margin but it could also be located otherwise or be oriented any way desirable as long as it provides access to the valve stems.

Referring again to FIGS. 4 and 5, the bladders are preferably inflatable independent of each other. With the inner bladder 4 deflated or inflated to less than or equal pressure than the outer bladder 6, the pad provides a general cushioning support for a seated person, but can also be selectively tilted by movement of the person's lower body. The inner bladder can also be inflated to greater pressure than the outer bladder to make it less elastic than the outer bladder. In this case the inner bladder will act as a fulcrum for more pronounced and easier tilting of the top plate. Preferably the pressure in each of the bladders can be varied at will, as well as the differential in pressure between them, in order to increase or decrease the tilting action, firmness and comfort. This flexibility in pressures allows the pad to accommodate individual preferences and persons of diverse weight. Since the elastic support for the pad is a gas-filled bladder assembly, it has a reactive elastic force which remains substantially normal to the top plate regardless of the orientation of the plate with respect to its medians. The term "substantially" is used because there is another force caused by tilting the top plate which is not normal to the top plate. When the top plate is tilted, a relatively small torque opposing the tilt is caused by the bladders trying to equalize the gas distribution therein.

Figure 2:
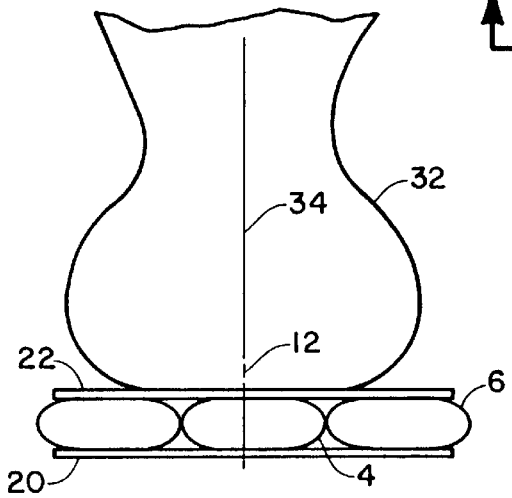
FIG. 2 is a rear cross-sectional view of a person seated on the illustrated embodiment of this invention, the cross-section being taken along a lateral median line not shown.

Referring to FIG. 2, a seated person 32 is seated upon a pad according to this invention. The cushioning material and cover are not shown for clarity of understanding. The seated person is supported by the top plate 22, and the top plate is, in turn, supported by the inflated inner and outer bladders, 4 and 6 respectively. The bladders rest upon the base plate 20 which, in turn, rests upon a foundation (not shown), such as the seat of a chair on which the pad is disposed. When the person's weight is evenly distributed over the top plate and centered on the vertical axis 12, the top plate will be generally horizontal, and the person's spine, designated by line 34, will be straight and aligned generally vertically when viewed from the rear. Normally, the base plate 20 will be supported by a horizontal foundation, in which case it will be in a horizontal plane. However, the base plate need not be in a horizontal plane. The bladders will adjust, allowing the top plate to be generally laterally horizontal when the weight is centered on a front-to-back median of the top plate, even though the base plate is not horizontal.

Figure 3:
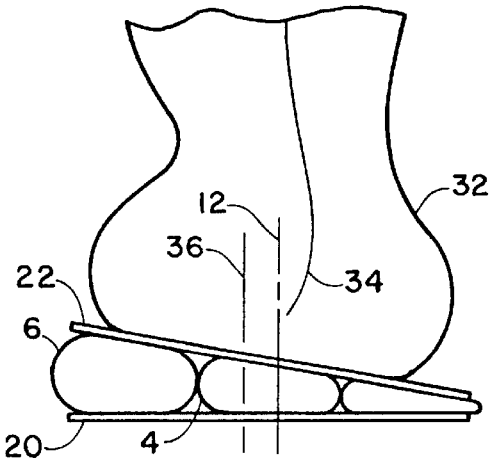
FIG. 3 is another rear cross-sectional view of a person seated on the illustrated embodiment of this invention, the cross-section being taken as in FIG. 2, this figure illustrating the effect of the person shifting his/her weight to the right.

Referring to FIG. 3, when the weight of the seated person 32 is shifted slightly from the axis 12, the pad reacts to the weight shift. First, there is a tendency of one side of the bladders, 4 and 6, to compress due to the increase in the distribution of weight on that side (the right side as shown). Second, the reduction in the weight distribution on the opposite side of the weight shift, together with the air displaced from the side being compressed, causes the opposite side of the bladders (the left side as shown) to expand. This bladder expansion on one side exaggerates the tilt of the top plate 22 downward on the side to which the weight has shifted. Third, a firmly inflated inner bladder 4 acts as a pivot, accentuating the tilting of the top plate. Fourth, the tilting of the top plate affects the inner bladder, causing its pivoting axis 36, normally aligned with the vertical axis 12, to be displaced slightly away from the vertical axis some distance toward the side in which the bladders have expanded (the left side as shown). This pivoting axis displacement further exaggerates the tilt of the top plate downward on the side to which the weight has shifted. Likewise, if the seated person's weight is shifted to the left of the vertical axis 12, the top plate will pivot on the inner bladder and compress the outer bladder on the side to which the weight has shifted (the left side) and thereby allow the outer bladder to expand on the opposite side (the right side).

Referring again to FIG. 3, the line 34 designating the spine of the seated person, is no longer aligned with the vertical axis 12, but is bowed convexly toward the side to which the person's weight has shifted. This is due to the contraction of some flexor muscles and the relaxing of some extensor muscles in the lumbar cage to bend the spine in order to keep the person's upper body in an upright position and to maintain balance. The muscles in the lumbar cage also connect with those in the pelvis. In the tilted position shown, the pelvis is also tilted in relation to the spine, with its right side lower than the left side, requiring the contraction of muscles on one side (the left side) and relaxation of muscles on the other side. If the person's weight is shifted to the opposite side (toward the left), beyond the inner bladder's pivoting axis 36, the top plate 22 will pivot on the inner bladder 4 and compress the outer bladder 6 on the side to which the weight has shifted (the left side), allowing the outer bladder to expand on its opposite side (the right side). As this is done, both bladders will collapse on the left and expand on the right, the pivoting axis will then move to the right (not shown) of the axis. The line 34 designating the person's spine will then be bowed convexly to the left (not shown) and the pelvis will be tilted so it is lower on the left side than on the right (not shown).

To accomplish such shifts in the person's weight requires the complex and coordinated control of the muscles in the lumbar cage, pelvic region and the upper body. These muscles work together to shift the person's weight from one side to the other by rocking the pelvis from the one side to the other side. This is done by: bending the spine to cause a slight leaning of the upper body to the side of the weight shift; straightening of the spine in the lumbar region; and then bending it in the opposite direction to accomplish the weight shift. In doing this, the muscles work together, some contracting and some relaxing, to maintain the person's control and balance. While the person's weight is being shifted from side to side, the shape of person's spine is being changed from being bowed to one side to being bowed to the opposite side. While the decision to shift weight is a conscious decision, the control and contraction of the individual muscles is primarily performed sub-consciously by the person's balance control. In performing such weight shifts, the muscles in the lumbar cage, including those interconnecting with the pelvis and upper body, are worked and exercised.

Since the pad can be used by a person while seated at work, it provides a means for the person to exercise the muscles in the lumbar cage while working. This invention allows lumbar exercise to be done on a continuing basis by using only normal or unobtrusive weight shifts, and with each weight shift the muscles are worked and exercised, keeping them active, flexible, and promoting their healthy tone and improving their strength. Formerly, sedentary jobs which required a person to sit at a desk, or in front of a computer monitor, meant long periods of inactivity for the lumbar cage, contributing to atrophy of the muscles and eventual lower back problems. With this invention, normal body movement during use will cause the lumbar cage muscles to be exercised. Thus, this invention provides effective back pain therapy during the very same type of sedentary tasks which would otherwise cause back pain in the first place, and continued use strengthens the lumbar cage.

While exercising the muscles of the lumbar cage to improve their strength and general health is of primary importance, muscles are controlled by nerves and the benefits of active, exercised muscles also affects the nervous system. In providing the signals which control the contractions of the lumbar cage muscles, the nervous system also benefits from the exercise provided by this invention. As with exercise of the muscles, use of the nervous system keeps the system healthy and prevents atrophy due to inactivity. The above-described exercise improves nervous system response time and muscle control. Likewise, use of the pad to exercise the lumbar cage muscles requires blood flow to the muscles, and adequate exchange of oxygen and carbon dioxide in capillaries to keep the muscles nourished and healthy while they are exercised. Thus, a person using the pad is also enhancing the vascular system's ability to supply blood and nutrients to the muscles, improving their ability to work. This increasing blood flow resulting from the increased muscle activity improves the health of the vascular system in the lumbar cage and its ability to supply blood to the muscles, thereby preventing their further atrophy.

Also, flexing the spine by use of the pad causes adjacent vertebrae to compress one side of the intervertebral discs, and then the other side, similar in fashion to the compression of the bladders, 4 and 6. This pumping action promotes the exchange of fluids into and out of the discs, thereby improving their ability to resist degeneration and maintain their healthy, hydrated flexibility.

Thus, use of the pad to exercise the lumbar cage not only exercises the muscles, improving their strength and ability to prevent lower back problems, but it also improves the nervous system, vascular system and the health of the intervertebral discs as well.

Figure 1:
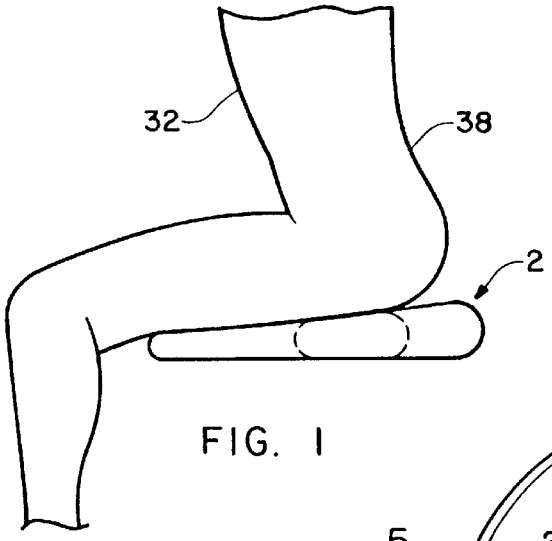
FIG. 1 is a side elevational view of a person seated on an embodiment of this invention, an inner bladder being shown in dashed lines.

Referring to FIG. 1, use of the pad has additional advantages: improving posture or maintaining good posture. A person 32 seated on the pad will tend to compress the outer bladder in the front, the direction in which the person is facing, due to the person's thighs tending to compress the front of the outer bladder. This also tends to compress the front of the inner bladder 4, pushing it slightly to the rear where the outer bladder is slightly expanded. This causes the top plate to be tilted slightly forward. With the top of the pad tilted in this manner, a seated person tends to shift his or her upper torso and shoulders slightly to the rear in order to balance his or her weight, rather than support their upper body weight by the arms or by large back muscles. This causes a slight forward curvature of the spine, leaving the lower back 38 slightly swaybacked, as shown. Such a slight, forwardly bowed spine helps to keep the shoulders generally in line above the hip joints, which is a preferred seated posture, rather than a slouched position with the spine generally bent forward. This forward curve of the spine is often referred to as "lumbar lordosis" and is similar to the forward curvature of the spine in the neck which is commonly referred to as cervical lordosis. This is a natural curvature, similar to the forward curvature in the lumbar region when a person is standing upright in an unstressed position. (As used herein "lumbar lordosis" refers to a natural forward curvature rather than an abnormal curvature to which the diagnosis of "lordosis" has also been applied.) Also, the natural lumbar lordosis curvature is promoted by use of the pad, not only by the tendency of the top plate to tilt forward and thus cause the back to bend, placing the shoulders back to maintain balance, but also as a result of strengthened lumbar cage muscles, which occurs from use of the pad.

The foregoing description and drawings were given for illustrative purposes only, it being understood that the invention is not limited to the embodiments disclosed, but is intended to embrace any and all alternatives, equivalents, modifications and rearrangements of elements falling within the scope of the invention as defined by the following claims. For example, the seating pad is preferably reversible, that is, there is no absolute top or bottom—it can be used with one side up and then flipped over and used just as effectively with the other side up. The bladders could also be constructed with appropriate valves to hold a liquid, with each bladder individually inflatable to selected pressures. Also, the bladders can have different forms than previously disclosed. For example they can be rectangular, obtuse, or have any other form or forms which functions as described to exercise the lumbar cage. Also, the inner and outer bladders can be separate pieces held in relation to each other by the other components of the invention, or they can be connected integrally, for example, by means of an air tight seam joining them around the inner bladder margin. Also, the surface upon which a person sits need not be entirely planar but rather can have, for example, depressions to more comfortably support the buttocks of a seated person. In addition, the pad could as well be incorporated as the seating surface of a chair, with a separate pump attached to each bladder and pump handles conveniently available for adjusting the pressure of each bladder in a manner commonly used in adjustable elevation chairs.

I claim:

1. A device for exercising the lumbar region of a person seated upon it, the device comprising:

(a) a rigid surface upon which the person sits upright;

(b) means for elastically supporting the surface, said means allowing the surface to be rotated around two mutually orthogonal medians of the surface by selected movement of the person's lower body.

2. The device according to claim 1 wherein the means for supporting has a reactive elastic force which remains substantially normal to the surface regardless of the orientation of the surface with respect to the medians.

3. The device according to claim 1 wherein the means for supporting comprises a gas, and elastic means for confining the gas.

4. The device according to claim 2 wherein the means for supporting comprises a gas, and elastic means for confining the gas.

5. The device according to claim 1 wherein the means for supporting comprises:

(a) a bladder assembly comprising:

(1) a first elastic bladder inflated with a gas, and (2) a second elastic bladder inflated with a gas, the second bladder circumscribing the first bladder; and (b) the bladder assembly being centrally disposed beneath the rigid surface and extensive to the margins of the surface.

6. The device according to claim 5 further comprising means for individually inflating the bladders each to a selected pressure.

7. The device according to claim 6 further comprising:

(a) a base plate, the bladder assembly being sandwiched between the rigid surface and the base plate; and (b) a cover for enveloping the sandwich.

8. The device according to claim 7 further comprising a gap in the second bladder for inflation access to the first bladder.

9. The device according to claim 7 further comprising cushioning atop the rigid surface but within the enveloping cover.

10. The device according to claim 1 wherein the means for supporting comprises:

(a) a bladder assembly comprising:

(1) a circular elastic bladder inflated with a gas, and (2) a toroidal elastic bladder inflated with a gas, the toroidal bladder circumscribing the circular bladder; and (b) the bladder assembly being centrally disposed beneath the rigid surface and extensive to the margins of the surface.

11. The device according to claim 10 further comprising means for individually inflating the bladders each to a selected pressure.

12. The device according to claim 11 further comprising:

(a) a base plate, the bladder assembly being sandwiched between the rigid surface and the base plate; and (b) a cover for enveloping the sandwich.

13. The device according to claim 12 further comprising a gap in the second bladder for inflation access to the first bladder.

14. The device according to claim 12 further comprising cushioning atop the rigid surface but within the enveloping cover.

* * * * *